US005771797A

United States Patent [19]

Dubuit

[11] Patent Number: 5,771,797

[45] Date of Patent: Jun. 30, 1998

[54] PRINTING MACHINE WITH PRESENCE DETECTOR ASSOCIATED WITH AN OBJECT SUPPORT

[75] Inventor: Jean-Louis Dubuit, Paris, France

[73] Assignee: Societe d'Exploitation des Machines Dubuit, Noisy Le Grand, France

[21] Appl. No.: 855,481

[22] Filed: May 13, 1997

[30] Foreign Application Priority Data

Jun. 3, 1996 [FR] France ..... 96 06797

[51] Int. Cl.[6] ..... B41F 17/00

[52] U.S. Cl. ..... 101/37; 101/36

[58] Field of Search ..... 101/37, 36, 35, 101/389.1

[56] References Cited

U.S. PATENT DOCUMENTS 5,165,340 11/1992 Karlyn ..... 101/126
5,456,169 10/1995 Rohwetter ..... 101/35
5,520,107 5/1996 Airoldi ..... 101/35
5,609,102 3/1997 Rapp ..... 101/35

FOREIGN PATENT DOCUMENTS 2714867 1/1994 France .
4326794 2/1995 Germany .

*Primary Examiner*—Edgar S. Burr
*Assistant Examiner*—Daniel J. Colilla
*Attorney, Agent, or Firm*—Young & Thompson

[57] ABSTRACT

A printing machine comprises a frame, a turntable or other object circulating device on the frame for carrying an object support to a print head. The object support includes a plate with a plurality of suction ports opening onto a receiving surface of the plate. A suction source is connected to the suction ports by a conduit. Elastically deformable bellows is connected to the pipe. The bellows has a closed free end. A displacement detector is responsive to the position of the free end of the bellows for detecting the presence of an object on the plate.

11 Claims, 1 Drawing Sheet

PRINTING MACHINE WITH PRESENCE DETECTOR ASSOCIATED WITH AN OBJECT SUPPORT

BACKGROUND OF THE INVENTION

1. Field of the Invention

The present invention is generally concerned with printing machines of the kind including a circulation unit that carries at least one object support adapted to receive an object to be printed and which, mobile relative to a frame, moves the object support to at least one print head.

It is more particularly aimed at the situation in which the object support includes a plate which is adapted to receive the object to be printed and on to the corresponding surface of which opens at least one suction hole, and in practise a plurality of suction holes, for retaining the object, connected to a suction source by appropriately controlled pipe means.

Even more particularly, the present invention is aimed at the situation in which a presence detector responsive to the presence of an object on the base of the object support is associated with an object support of this kind.

The function of the presence detector is to stop the circulation unit and/or the print head if there is no object on the object support.

This can be the result of a failure to supply objects to be printed to the printing machine or a malfunction which has caused an object to remain inappropriately stuck to the bottom of a print head further upstream which has already had to operate on the object.

If, in either case, the circulation unit and/or the print head were to continue to function, the print head would inadvertently soil the object support when it operates.

2. Description of the Prior Art

The presence detector usually employed at present to avoid this problem requires a dedicated hole in the object support, parallel to the suction hole.

It is in practise a photo-electric cell, combining emitter and receiver, sighting the object through this dedicated hole, or sighting hole, and therefore operative directly by virtue of the hole.

This arrangement has given satisfaction and may continue to do so, but has the following disadvantages:

First of all, it implies that the object to be printed is reflective.

If the object is a compact disc, it is therefore necessary for the compact disc to be metalized.

Although this is usually the case for compact discs as sold at present, this will not necessarily always be the case in the future.

Also, and more importantly, the sighting hole used must have a transverse diameter sufficiently large to assure the operation of a photo-electric cell without difficulties and to enable operation of the latter without incident.

In practise the diameter of the sighting hole is usually at least around 5 mm at present.

If the print head is an offset print head, the sighting hole then causes other problems, associated with the high pressure that must necessarily be applied to the object to be printed by the blanket roller of an offset print head to transfer to the object the ink previously picked up from a printing plate.

If the object to be printed is relatively thin, and therefore deformable, as is the case with a compact disc, it is not sufficiently stiff at the location of the sighting hole if the latter has a relatively large diameter, and this causes a printing defect at this location causing the pattern or the text here to be lighter than elsewhere.

A general object of the present invention is an arrangement which, whilst retaining the use of a presence detector, advantageously avoids this drawback.

SUMMARY OF THE INVENTION

To be more precise, the present invention consists in a printing machine of the kind including a circulation unit which carries at least one object support and which, mobile relative to a frame, moves the object support to at least one print head, the object support including a plate adapted to receive the object to be printed and onto the corresponding surface of which opens at least one suction hole for retaining the object to be printed connected to a suction source by pipe means, with, associated with this object support, a presence detector responsive to the presence of an object to be printed on its plate, wherein the presence detector associated with the object support includes an elastically deformable bellows branching off the pipe means and the free end of which is closed and a displacement detector responsive to the position of said free end of said bellows.

According to whether an object to be printed is present or not on the object support plate, the bellows provided in accordance with the invention is in the retracted or the deployed configuration and the displacement detector associated with its free end operates accordingly.

However, in accordance with the invention, because the presence detector constituted in this way no longer operates directly on the object present on the object support, there is no longer any requirement for sighting through the object support, which is advantageous because there is no need for the sighting hole usually provided for this purpose and the object support is no longer subject to the dimensional constraints that normally have to be complied with in respect of this sighting hole.

The suction hole to which the pipe means are connected to enable the use of the presence detector in accordance with the invention can advantageously have a relatively small diameter, like the other suction holes and in any event very much less than that required for a sighting hole.

For example, in accordance with the invention, the diameter of this suction hole can advantageously be not more than 3 mm.

Experience indicates, and tests confirm, that with a suction hole as narrow as this there is no longer any perceptible printing defects at the location of a suction hole, even if the corresponding print head is an offset print head.

Moreover, the presence detector of the invention has the advantage of being equally suitable for objects to be printed that are reflective and those that are not reflective.

Finally, it may advantageously be placed at any point on the pipe means connecting the suction holes to the suction source and therefore, if required, at a distance from the object support, which facilitates providing room for it in some cases at least.

The features and advantages of the invention will emerge from the following description given by way of example with reference to the accompanying diagrammatic drawings.

DETAILED DESCRIPTION OF THE PREFERRED EMBODIMENT

Figure 1:
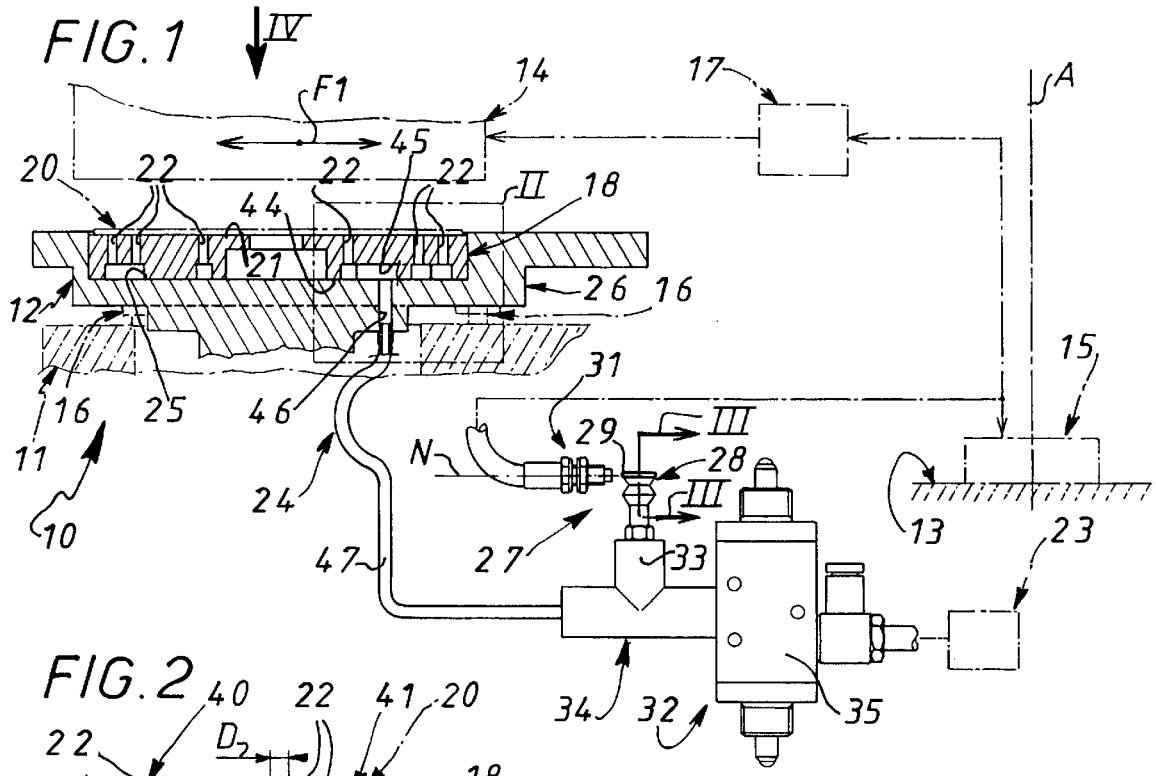
FIG. 1 is a fragmentary view in elevation and axial section of a printing machine of the invention, taken along the broken line I—I in FIG. 4.

As shown in the figures, and in a manner that is known in itself, the printing machine 10 of the invention includes a circulation unit 11 which carries at least one object support 12 and, being mobile relative to a frame 13, moves the object support 12 to at least one print head 14.

The printing machine 10 will not be described in complete detail here.

Only its components necessary to an understanding of the invention will be described.

This is why, in FIG. 1, the circulation unit 11, the frame 13 and the print head 14 are shown diagrammatically and only in part, in chain-dotted outline.

In the embodiment shown, the circulation unit 11 is a turntable rotating about its axis A relative to the frame 13 under the control of a control device 15 carried by the frame 13.

Of course, it carries a plurality of object supports 12 which are regularly distributed along its periphery and appropriately attached to it by fixing means 16 that preferably enable their position relative to it to be adjusted.

A circulation unit 11 of this kind being well known in itself, and not being relevant in itself to the present invention, it will not be described in more detail here.

Likewise its control device 15, which in practise operates stepwise, and the fixing means 16 for an object support 12.

The construction of the frame 13 will be obvious to the person skilled in the art.

Similarly, the print head 14 is well known in itself and, not being relevant to the present invention, will not be described here.

It is an offset print head, for example, mobile relative to the circulation unit 11 under the control of a control device 17 in order to sweep successively across a printing plate, not shown, and an object support 12.

If, as here, the circulation unit 11 is a turntable, the direction in which the print head 14 moves is a radial direction of the turntable, as shown diagrammatically by a double-headed arrow F1 in FIG. 1.

Of course, a plurality of print heads 14 may be provided, appropriately distributed along the path of the circulation unit 11, possibly alternating with drying ovens, not shown.

If, as here, the circulation unit 11 is a turntable, the print heads 14 are circumferentially distributed about its axis A.

In a manner that is also known in itself, the object support 12 includes a plate 18 adapted to receive the object 20 to be printed and onto the corresponding surface 21 of which opens at least one suction hole 22 connected to a suction source 23 by pipe means 24 for retaining the object 20 to be printed.

Figure 2:
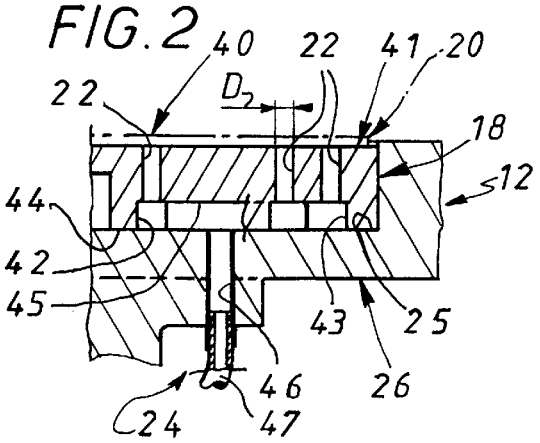
FIG. 2 shows the detail II of FIG. 1 to a larger scale.
Figure 4:
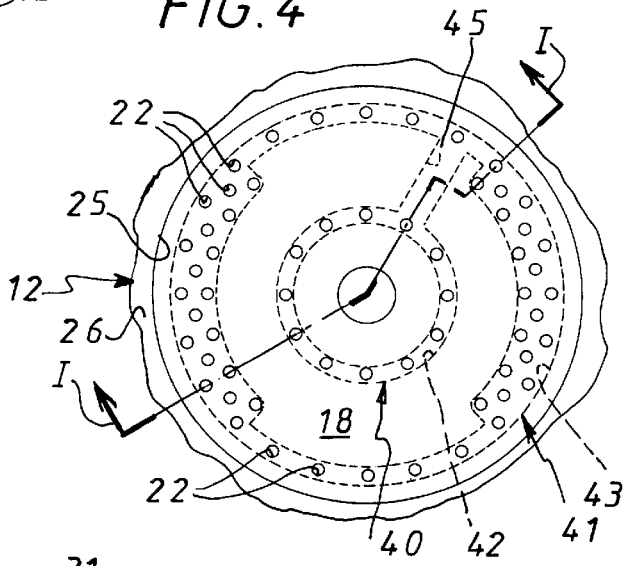
FIG. 4 is a fragmentary plan view of the object support, as seen in the direction of the arrow IV in FIG. 1.

If, as here, and as shown diagrammatically in chain-dotted outline in FIGS. 1 and 2, the object 20 to be printed is a compact disc, the plate 18 has a circular contour and its surface 21, which is its top surface, is plane.

In the embodiment shown, the plate 18 is recessed into a housing 25 provided for it in a base 26 and with this base 26 it forms the object support 12.

Of course, and by virtue of arrangements described in more detail below, the plate 18 includes a plurality of suction holes 22 all of which are connected to the pipe means 24.

It preferably also includes, in its central area, centering means, not shown, adapted to locate the object 20 to be printed correctly on it.

Finally, in a manner that is known in itself, the object support 12 is associated with a presence detector 27 responsive to the presence of an object 20 to be printed on the plate 18 of the object support 12.

In accordance with the invention, the presence detector 27 includes an elastically deformable bellows 28 which branches off the pipe means 24, by means of a simple lateral tap on the latter, and the free end of which 29 is closed by a diaphragm 30, and a displacement detector 31 which is responsive to the position of the free end 29 of the bellows 28.

As shown here, for example, the pipe means 24 include, between the object support 12 and the suction source 23, a mechanically operated air switch 32 controlling application or non-application of suction to the object support 12, the bellows 28 being between this air switch 32 and the object support 12.

In the embodiment shown, the bellows 28 is carried by the central leg 33 of a Tee connector 34 between the object support 12 and the air switch 32, attached to the body 35 of the latter and forming part of the pipe means 24.

In the arrangement described below, the bellows 28 or at least its lateral wall is made from a synthetic material, for example.

The transverse diaphragm 30 that closes its free end 29 can be made of metal.

In the embodiment shown, the bellows 28 is limited to two concertina folds 36, 37, one inwards and the other outwards.

However, as shown here, the outside of its free end 29 preferably forms a cylindrical bearing surface 38 to facilitate the operation of the displacement detector 31.

In the embodiment shown, the diaphragm 30 is at the same level as the edge of this cylindrical bearing surface 38, but it is not necessarily so.

Figure 3:
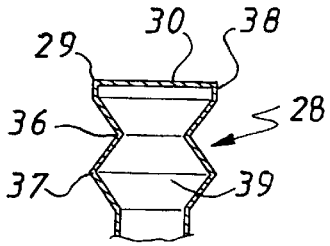
FIG. 3 is, also to a larger scale, a fragmentary view in axial section of the bellows included in the presence detector associated in accordance with the invention with an object support of the printing machine.
Figure 5:
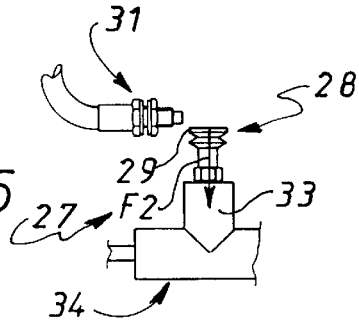
FIG. 5 is a fragmentary elevation view which, repeating part of FIG. 1, shows the operation of the presence detector of the invention.

Because of its construction, the bellows 28 is able to pass from a deployed configuration, which is its rest configuration, as shown in FIGS. 1 and 3, to a retracted configuration, which is its configuration when its interior volume 39 is depressurized, as shown in FIG. 5, and to revert by its inherent elasticity from its retracted configuration to its deployed configuration when its interior volume 39 is vented to the atmosphere.

The displacement detector 31 of the presence detector 27 of the invention may be a photo-electric cell, for example, carried by the frame 13 at a level N globally corresponding to the position of the free end 29 of the bellows 28 in the rest configuration of the latter.

If, as here, the bellows 28 forms a cylindrical bearing surface 38 at its free end 29, the latter is equivalent to this cylindrical bearing surface 38, in terms of the level N.

The photo-electric cell constituting the displacement detector 31 can be a combined emitting and receiving photo-electric cell, for example.

If, in this case, the bellows 28 is made from a synthetic material, it is preferably at least locally metalized to obtain a good quality of the necessary reflection.

As an alternative, the displacement detector 31 may be a proximity detector, not shown.

In this case, and as previously indicated, the diaphragm 30 is preferably made of metal or metaled.

In all cases, and as shown in chain-dotted outline in FIG. 1, the control device 15 of the circulation unit 11 and/or that 17 of the print head 14 is under the control of the presence detector 27 associated with the object support 12.

In the embodiment shown, the suction holes 22 in the plate 18 of the object support 12 are circumferentially distributed in two areas 40, 41, one of which is central and the other of which is peripheral, and they are conjointly connected to at least one suction chamber 42, 43 forming part of the pipe means 24.

In practise there are two suction chambers 42, 43, one for the suction holes 22 in the central area 40 and the other for the suction holes 22 in the peripheral area 41, and the two suction chambers 42, 43, which are annular and coaxial, are on the bottom surface 44 of the plate 18 and connected together by a radially recessed slot 45 on this bottom surface 44.

The housing 25 into which the plate 18 is recessed has a bore 46 in line with the slot 45, forming part of the pipe means 24 and connected by a pipe 47 which is also part of the pipe means 24 to the Tee connector 34 attached to the air switch 32.

In the embodiment shown the central area 40 of suction holes 22 includes only one row of suction holes 22.

On the other hand, there are several rows of suction holes 22 in two diametrally opposite portions of the peripheral area 41 of suction holes 22.

As shown here, for example, three rows of suction holes 22 are provided locally in this peripheral area 41 and the suction holes 22 alternate between the rows.

The two portions of the peripheral area 41 in which there are several rows of suction holes 22 in practise extend conjointly in the direction in which the print head 14 moves, to strengthen the retention of the portions of the object 20 to be printed with which the print head 14 enters into contact or from which it moves away from it.

If, as here, the print head 14 is an offset print head, the suction holes 22, which are all identical, have a diameter D in accordance with the invention at most equal to 3 mm.

If, as shown diagrammatically in chain-dotted outline in FIGS. 1 and 2, an object 20 to be printed is present on the plate 18 of the object support 12, the suction holes 22 are all blocked.

Consequently the pipe means 24 and the interior volume 39 of the bellows 28 are depressurized by the suction source 23 which holds the object 20 to be printed onto the object support 12 and constrains the bellows 28 to change, against its inherent elasticity, from its deployed configuration to its retracted configuration, as shown diagrammatically by an arrow F2 in FIG. 5.

In this case the associated displacement detector 31 is inactive.

On the other hand, if there is no object 20 to be printed on the plate 18 of the object support 12 the interior volume 39 of the bellows 28 is vented to atmosphere.

The bellows 28 is then in its rest or deployed configuration, as shown in FIGS. 1 and 3.

Excited by reflection at the free end 29 of the bellows 28, the displacement detector 31 then commands the stopping of the circulation unit 11 and/or the print head 14.

Of course, the present invention is not limited to the embodiment described and shown, but encompasses any variant execution thereof.

There is claimed:

1. In a printing machine comprising a frame, at least one print head an object circulation unit supported by the frame carrying at least one object support for movement to said at least one print head, said object support including a plate for receiving an object to be printed, said plate having a receiving surface, at least one suction port opening on to said receiving surface, pipe means connecting said at least one suction port to a suction source, the improvement comprising a presence detector responsive to the presence of an object to be printed on said plate, said presence detector including an elastically deformable bellows, said bellows being connected to said pipe means, said bellows having a closed free end, and a displacement detector responsive to the position of said free end of said bellows.

2. The printing machine claimed in claim 1, wherein said at least one print head comprises at least one offset print head and said suction port has a diameter at most equal to 3 mm.

3. The printing machine claimed in claim 1 wherein the object to be printed is a compact disc, said plate having a circular contour, said at least one suction port comprising a plurality of suction ports circumferentially arranged respectively in a central area and in a peripheral area, and at least one suction chamber connected to said plurality of suction ports and defining part of said pipe means.

4. The print machine claimed in claim 2 wherein said suction ports arranged in a peripheral area are disposed in two diametrically opposite arrays, each of said arrays including a plurality of rows of suction ports.

5. The printing machine claimed in claim 1 wherein said at least one print head comprises at least one offset print head arranged for movement in a direction, said at least one suction port comprising at least two suction ports in a peripheral area are disposed in two diametrically opposite arrays, each of said arrays including a plurality of rows of suction ports and said two arrays of the peripheral area extending conjointly in the direction of movement of-the at least one offset print head.

6. The printing machine claimed in claim 1 wherein said object circulation unit comprises a turntable rotatable about an axis thereof.

7. The printing machine claimed in claim 6, wherein said at least one print head comprises at least one offset print head arranged for movement in a direction, said at least one suction port comprises at least two suction ports arranged in a peripheral area and are disposed in two diametrically opposite arrays, each of said arrays including a plurality of rows of suction ports and said two arrays of the peripheral area extend conjointly in the direction of movement of the at least one offset print head being a radial direction of the turntable.

8. The printing machine claimed in claim 1, wherein said bellow has a rest configuration and said displacement detector comprising a photo-electric cell disposed at a level corresponding to the position of said free end of said bellows in the rest configuration.

9. The printing machine claimed in claim 1, wherein said displacement detector comprises a proximity detector, said free end of said bellows being defined by a metal or metallized diaphragm.

10. The printing machine claimed in claim 1, wherein control means for at least one of said circulation unit and said print head are responsive to said presence detector.

11. The printing machine claimed in claim 1, wherein said bellows defines a cylindrical bearing surface at the free end thereof.

* * * * *